US007876193B2

(12) United States Patent
Pavlovic et al.

(10) Patent No.: US 7,876,193 B2
(45) Date of Patent: Jan. 25, 2011

(54) FUSE CIRCUIT ASSEMBLY

(75) Inventors: Slobodan Pavlovic, Canton, MI (US); David Menzies, Sterling Heights, MI (US); Mohamad Zeidan, Dearborn Heights, MI (US)

(73) Assignee: Lear Corporation, Southfield, MI (US)

( * ) Notice: Subject to any disclaimer, the term of this patent is extended or adjusted under 35 U.S.C. 154(b) by 171 days.

(21) Appl. No.: 12/062,958

(22) Filed: Apr. 4, 2008

(65) Prior Publication Data

US 2009/0251274 A1 Oct. 8, 2009

(51) Int. Cl.
*H01H 85/143* (2006.01)
*H01H 85/56* (2006.01)

(52) U.S. Cl. ..... 337/229; 337/268; 337/187; 337/188; 337/189; 337/251; 439/890

(58) Field of Classification Search ..... 337/268, 337/187–189, 229, 251; 439/890
See application file for complete search history.

(56) References Cited

U.S. PATENT DOCUMENTS

| | | | | |
|---|---|---|---|---|
| 4,296,398 | A | 10/1981 | McGalliard | |
| 4,342,977 | A | 8/1982 | McGalliard | |
| 4,376,927 | A | 3/1983 | McGalliard | |
| 4,394,639 | A | 7/1983 | McGalliard | |
| 4,842,534 | A * | 6/1989 | Mobley et al. | 439/214 |
| 4,941,851 | A * | 7/1990 | Hsueh | 439/620.34 |
| 5,088,940 | A * | 2/1992 | Saito | 439/620.34 |
| 5,474,475 | A * | 12/1995 | Yamaguchi | 439/620.27 |
| 5,572,409 | A | 11/1996 | Nathan et al. | |
| 5,662,487 | A * | 9/1997 | Okamura et al. | 439/189 |
| 5,739,741 | A * | 4/1998 | Hanazaki et al. | 337/290 |
| 5,795,193 | A * | 8/1998 | Yang | 439/620.27 |
| 5,886,611 | A * | 3/1999 | Schaller et al. | 337/189 |
| 6,178,106 | B1 * | 1/2001 | Umemoto et al. | 363/146 |
| 6,431,880 | B1 * | 8/2002 | Davis et al. | 439/76.2 |
| 6,506,060 | B2 * | 1/2003 | Sumida et al. | 439/76.2 |
| 6,558,198 | B2 * | 5/2003 | Kobayashi et al. | 439/620.29 |
| 6,759,938 | B2 * | 7/2004 | Matsumura et al. | 337/161 |
| 6,815,841 | B1 | 11/2004 | Brown et al. | |
| 6,824,430 | B2 * | 11/2004 | Matsumura et al. | 439/620.29 |
| 6,878,004 | B2 | 4/2005 | Oh | |
| 7,071,808 | B2 * | 7/2006 | Nakamura | 337/256 |
| 7,592,892 | B2 * | 9/2009 | Ito et al. | 337/159 |
| 7,595,715 | B2 * | 9/2009 | Pavlovic et al. | 337/198 |
| 7,612,647 | B2 * | 11/2009 | Onoda et al. | 337/229 |
| 2003/0166352 | A1 | 9/2003 | Oh | |
| 2004/0124963 | A1 * | 7/2004 | Nakamura | 337/256 |
| 2006/0205267 | A1 * | 9/2006 | Darr et al. | 439/441 |
| 2008/0224814 | A1 * | 9/2008 | Pavlovic et al. | 337/164 |

FOREIGN PATENT DOCUMENTS

JP 2000133114 A * 5/2000

* cited by examiner

*Primary Examiner*—Anatoly Vortman
(74) *Attorney, Agent, or Firm*—Brooks Kushman P.C.

(57) ABSTRACT

A fuse circuit assembly having a power distribution bar for distributing power from a power input and an electrical terminal integral with the power distribution bar. The electrical terminal has a fuse element that is configured to open at an over current threshold in order to prevent current flow therethrough. The electrical terminal portion also has a female terminal portion.

11 Claims, 4 Drawing Sheets

FUSE CIRCUIT ASSEMBLY

BACKGROUND OF THE INVENTION

1. Field of the Invention

The invention disclosed herein relates to a fuse circuit assembly having female electrical terminals.

2. Background Art

A fuse circuit assembly having female electrical terminals is disclosed herein. Fuse circuit assemblies are disclosed in U.S. Pat. Nos. 6,878,004; 6,815,841; 5,572,409; 4,394,639; 4,376,927; 4,342,977; and 4,296,398.

SUMMARY OF THE INVENTION

A fuse circuit assembly is disclosed herein. In a first embodiment, the fuse circuit assembly comprises a power distribution bar for distributing power from a power input. The fuse circuit assembly further comprises an electrical terminal that is integral with the power distribution bar. The electrical terminal has a fuse element that is configured to open at an over current threshold in order to prevent current flow therethrough. The electrical terminal further includes a female terminal portion.

In an implementation of the first embodiment, the fuse circuit assembly comprises a plurality of the electrical terminals.

In another implementation of the first embodiment, the fuse element comprises the trace.

In another implementation, the fuse circuit assembly further comprises a terminal spring member that is connected to each female terminal portion. The terminal spring member may be configured to exert a normal force on the female terminal portion. In a variation, the terminal spring member comprises steel.

In another implementation of the first embodiment, a power distribution bar includes a crimping member.

In another implementation of the first embodiment, the power distribution bar includes an opening for a fastener.

In another implementation of the first embodiment, the power distribution bar comprises one of a crimping member and an opening for a fastener and wherein the fuse element comprises a trace. In a variation, the fuse circuit assembly further comprises a terminal spring member that is connected to the female terminal portion. The terminal spring member may be configured to exert a normal force on the female terminal portion.

In a second embodiment, the fuse circuit assembly comprises a power distribution bar for distributing power from a power input. The power distribution bar has an interface for receiving a female terminal. The fuse circuit assembly further comprises an electrical terminal having a first end and a second end disposed opposite the first end. The first end and the second end are each configured as a female terminal portion. The electrical terminal further has a fuse element that is disposed between the first and the second ends. The fuse element is configured to open at an over current threshold in order to prevent current flow therethrough. In this second embodiment, one of the first end and the second end is removably attached to the power distribution bar proximate the interface.

In an implementation of the second embodiment, the first end, the second end, and the fuse element are integral with one another.

In another implementation of the second embodiment, the fuse circuit assembly further comprises a plurality of the electrical terminals. In this implementation, the interface is adapted to receive a plurality of female terminals and one of the first and the second ends of each respective electrical terminal is removably attached to the power distribution bar proximate the interface. In a variation, the respective first end, second end, and fuse elements of each electrical terminal are integral with one another.

In another implementation of the second embodiment, the fuse circuit assembly further comprises a plurality of terminal spring members. One of the terminal spring members is connected to the first end and one of the terminal spring members is connected to the second end of each electrical terminal. The terminal spring member is configured to exert a normal force on the respective first end and second end. In a variation, each terminal spring member comprises steel. In another variation, each electrical terminal comprises copper.

In another implementation of the second embodiment, the fuse circuit assembly further comprises a housing for the fuse element. In a variation, the housing comprises plastic. In a further variation, the housing is transparent.

In a third embodiment, a fuse circuit assembly comprises a power distribution bar for distributing power from a power input. The power distribution bar has an interface for receiving a female terminal. The fuse circuit assembly further comprises a first electrical terminal having a first end and a second end that is disposed opposite to the first end. The first end and the second end are each configured as a female terminal portion. The first electrical terminal further has a fuse element that is disposed between the first and the second ends. The fuse element is configured to open at an over current threshold in order to prevent current flow therethrough. The fuse circuit assembly further comprises a second electrical terminal that is integral with the power distribution bar. The second electrical terminal has a fuse element that is configured to open at an over current threshold in order to prevent current flow therethrough. The second electrical terminal further includes a female terminal portion. In this third embodiment, one of the first end and the second end is removably attached to the power distribution bar proximate the interface. Further, the second electrical terminal is capable of tolerating a higher electrical current before opening its fuse element than the first electrical terminal.

BRIEF DESCRIPTION OF THE DRAWINGS

The description herein makes reference to the accompanying drawing wherein like reference numerals refer to like parts through the several views, and in which.

DETAILED DESCRIPTION OF THE ILLUSTRATED EMBODIMENT(S)

Detailed embodiments of the present invention are disclosed herein; however, it is to be understood that the disclosed embodiments are merely exemplary of the invention that may be embodied in various and alternative forms. The figures are not necessarily drawn to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
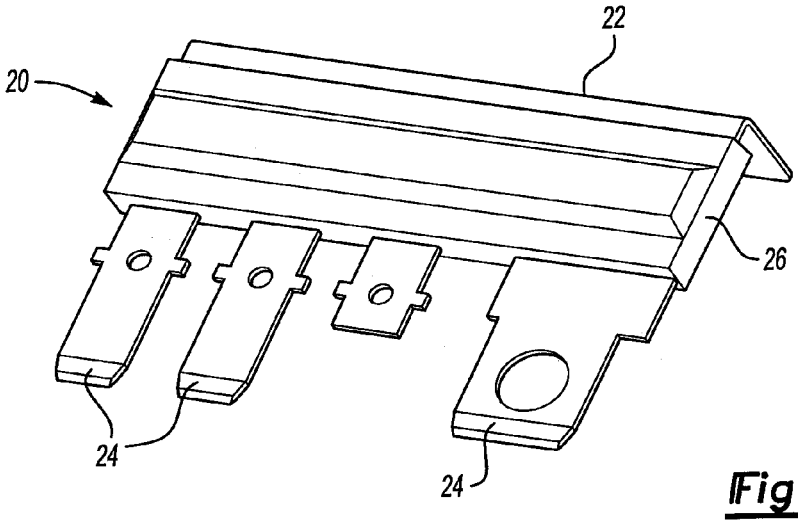
Fig-1 PRIOR ART
FIG. 1 is a perspective view illustrating a prior art fuse circuit assembly.

With reference to FIG. 1, a perspective view is presented of a prior art fuse circuit assembly 20 consisting of a power distribution bar 22, a plurality of male electrical terminals 24, a fuse element (not shown) associated with each male electrical terminal 24, and a housing 26. The male electrical terminals 24 are configured as blades and are adapted for insertion into female receivers associated with an electrical load(s). In a typical application, the female receivers comprise part of an electrical harness.

During electrical system overload, fuses and associated interfaces are exposed to currents that are up to 35% to 50% higher than the components can tolerate. These components may be exposed to these over currents for prolonged periods of time causing significantly increased temperatures in the terminals. Such high temperature can cause a stress relaxation of a spring member associated with the female terminal. While the spring member previously exerted high normal forces on the female terminal, once exposed to high temperatures, the female terminal spring member can relax. This relaxation results in lower normal forces and increased electrical resistance. Although the male electrical terminals 24 of prior art fuse circuit assembly 20 also experience high temperatures during over current conditions, because male electrical terminals do not require a spring member to maintain high normal forces, the male electrical terminals 24 remain robust and fit for continued engagement with female receivers.

When an electrical fuse circuit assembly such as prior art fuse circuit assembly 20 is replaced, the male electrical terminals 24 (which remain functional) are discarded while the corresponding female receivers on the harness that have been weakened by the over current condition, are not changed. Consequently, when a replacement prior art fuse circuit assembly 20 is connected to the weakened female connectors of a wire harness, lower that optimal normal forces are exerted on the replacement male electrical terminals 24. This can result in a less robust connection and an increased electrical resistance between the female receivers of the electrical harness and the replacement male electrical terminals.

Another problem frequently encountered by prior art fuse circuit assembly 20 is that when the over current condition blows the fuse element for only one of the male electrical terminals 24 and leaves the fuse elements of the remaining male electrical terminals 24 remain intact, there is no ability to replace only one of the male electrical terminals 24 of prior art fuse circuit assembly 20.

Figure 2:
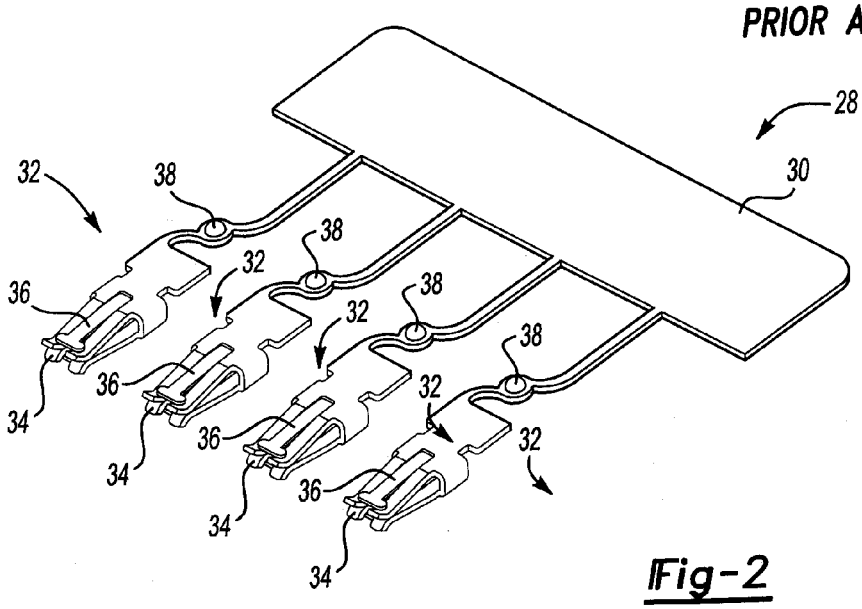
FIG. 2 is a perspective view illustrating an embodiment of a fuse circuit assembly made in accordance with the teachings of the present invention.

With reference to FIG. 2, a fuse circuit assembly 20 made in accordance with one non-limiting embodiment of the present invention is illustrated in perspective view. Fuse circuit assembly 20 includes a power distribution bar 30 to distribute electrical power between a number of female electrical terminals 32. One of ordinary skill in the art should understand that power distribution bar 30 may take other forms and have other shapes. Each female electrical terminal 32 includes a female receiver 34, a spring member 36 and a fuse element 38. Each female electrical terminal 32 is integrally formed with power distribution bar 30. Thus, a fuse circuit assembly 28 can be stamped as a single element.

Spring member 36 is configured to squeeze the two halves of female receiver 34 together to produce high normal forces to create a robust connection between female receiver 34 and a male counterpart. In some embodiments, spring member 36 may comprise steel. In other embodiments, spring member 36 may comprise materials including, but not limited to, steel alloys with adequate spring properties, and other metal alloys with appropriate mechanical properties and low stress relaxation at elevated temperatures. Fuse circuit assembly 28 is electrically conductive and may be made of materials including, but not limited to, copper, copper alloys (C151, C110) and other materials with appropriate conductivity.

Fuse element 38 has characteristics that cause it to open during over current conditions, such as, but not limited to, having a smaller dimension than the rest of female electrical terminal 32 and/or having a material (for example, tin) that melts before the rest of female electrical terminal 32 would melt when exposed to the elevated temperatures that accompany higher currents. As one skilled in the art will appreciate, the characteristics of fuse element 38 may be selected to correspond with desired over current operating conditions. In the illustrated embodiment, fuse element 38 is configured as a trace. In other embodiments, any fuse effective to prevent the transmission of electrical current in response to an over current condition.

Figure 3:
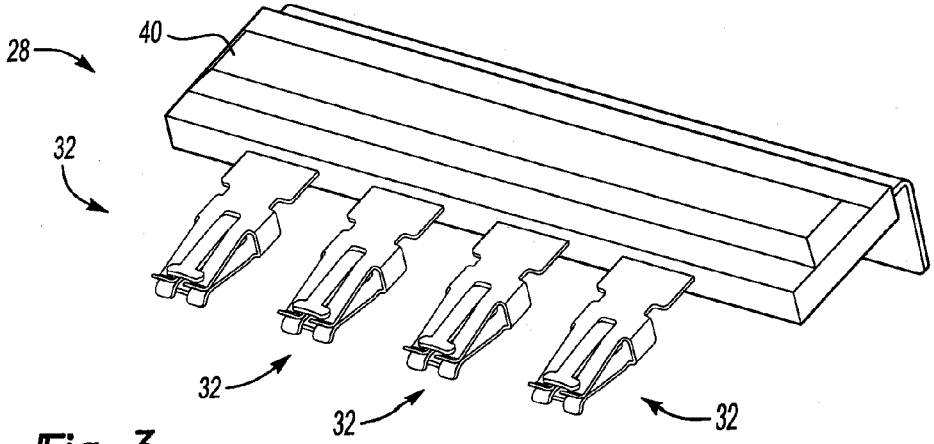
FIG. 3 is a perspective view illustrating an alternate configuration of the fuse circuit assembly of FIG. 2.

With respect to FIG. 3, fuse circuit assembly 28 is equipped with a housing 40. Housing 40 may provide structural support for the individual female electrical terminals 32. Housing 40 may also provide an insulated surface to allow a person to manipulate fuse circuit assembly 28 as electrical current is flowing through it. Housing 40 may be made of materials including, but not limited to, high temperature engineering polymers including, but not limited to, amodel, high temperature nylons, and PPS.

Figure 4:
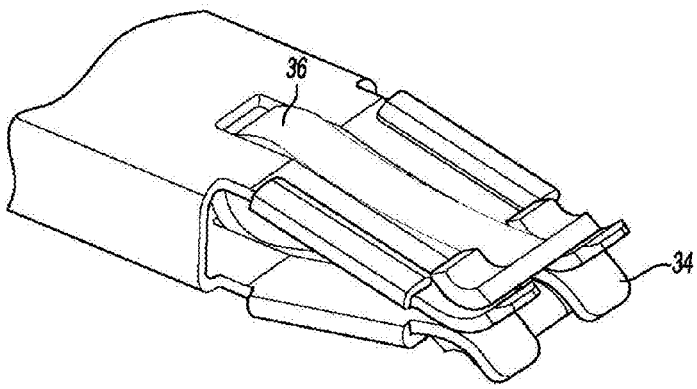
FIG. 4 is a perspective view illustrating a female terminal for use with the fuse circuit assembly of FIG. 2 configured with a spring member.

With respect to FIG. 4, a female receiver 34 configured with spring member 36 is illustrated.

Figure 5:
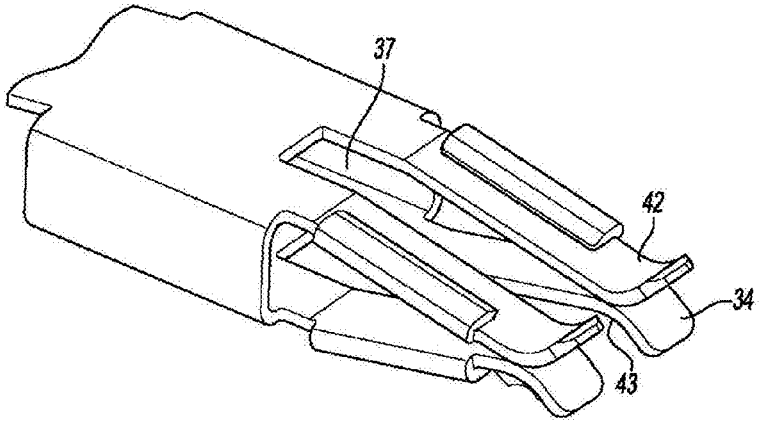
FIG. 5 is a perspective view illustrating the female terminal of FIG. 4 without the spring member.
Figure 6:
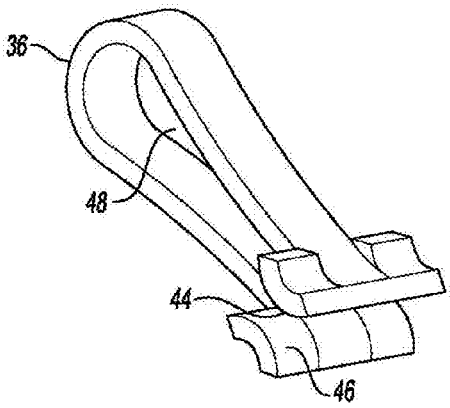
FIG. 6 is a perspective view illustrating the spring member for use with the female terminal of FIG. 4.

FIGS. 5 and 6 illustrate female receiver 34 and spring member 36 prior to assembly. As illustrated in FIG. 5, female receiver 34 includes detents 42 and 43 to receive inwardly curved surface 44 and inwardly curved surface 46 of spring member 36. Female receiver 34 also includes a docking portion 37. Spring member 36 is configured to bias inwardly curved surface 44 and inwardly curved surface 46 towards one another. When spring member 36 is seated within female receiver 34 such that inwardly curved surfaces 44 and 46 rest respectively in detents 42 and 43, inwardly curved surfaces 44 and 46 are wedged slightly apart and, accordingly, exert an inwardly directed force on respective detents 42 and 43. It is this bias of spring member 36 that contributes to the relatively high normal force acting on female receiver 34 to create a robust connection with a corresponding male terminal portion (not shown) while inserted into female receiver 34. Spring member 36 includes a receiving portion 48. When spring member 36 is assembled to female receiver 34, receiving portion 48 fits within docking portion 37. Receiving portion 48 is configured to avoid obstruction of a male terminal portion when inserted into female receiver 34.

Figure 7:
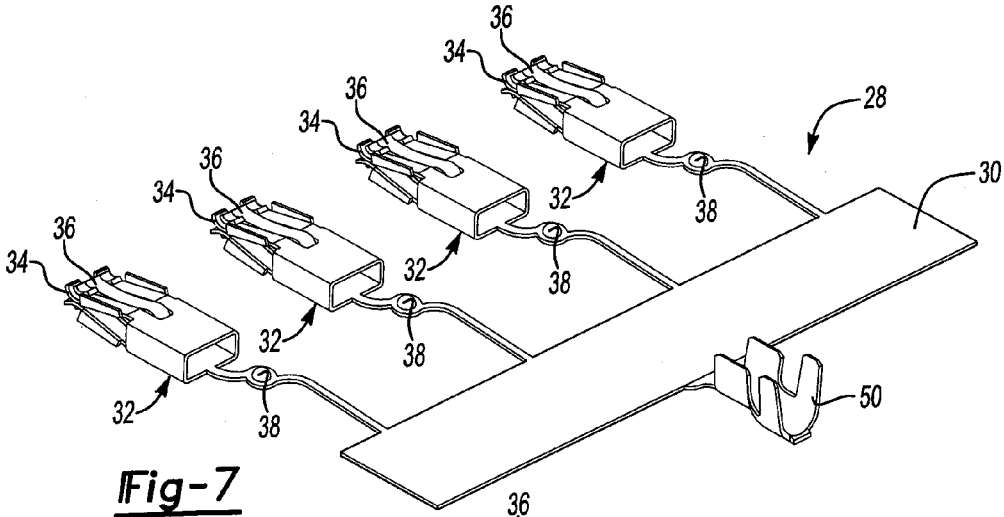
FIG. 7 is a perspective view illustrating a fuse circuit assembly made in accordance with the teachings of the present invention configured with a crimp interface.
Figure 8:
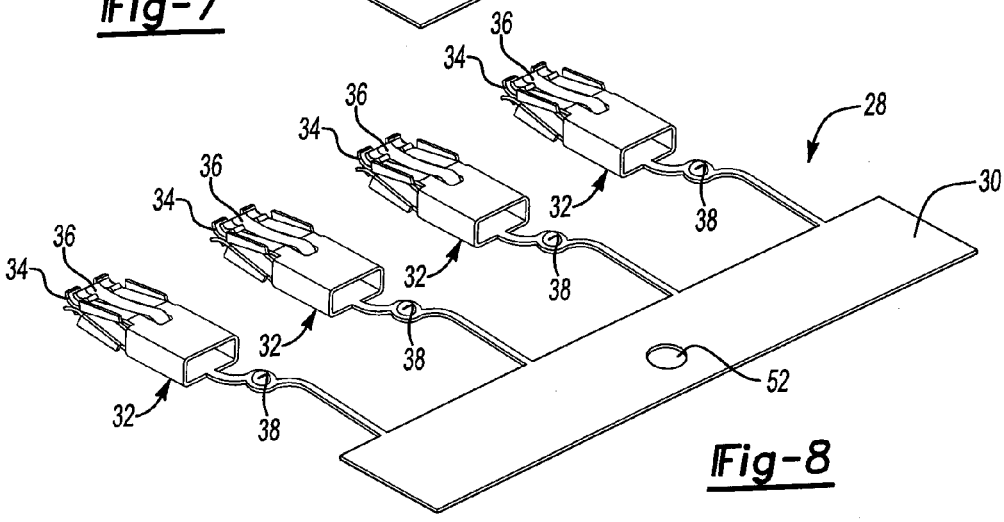
FIG. 8 is a perspective view illustrating a fuse circuit assembly made in accordance with the teachings of the present invention equipped with a bolting interface.

With respect to FIGS. 7 and 8, variations of fuse circuit assembly 28 are illustrated. In FIG. 7, a crimp interface 50 is attached to power distribution bar 30. This permits an electrically conductive portion of a wire assembly to be connected to fuse circuit assembly 28 by wrapping crimp interface 50 about the uninsulated wires of a wire assembly (not shown). In FIG. 8, power distribution bar 30 includes a bolt interface 52. In this configuration, fuse circuit assembly 28 may be attached to an electrical current source through the use of an electrically conductive fastener such as a bolt (not shown).

Figure 9:
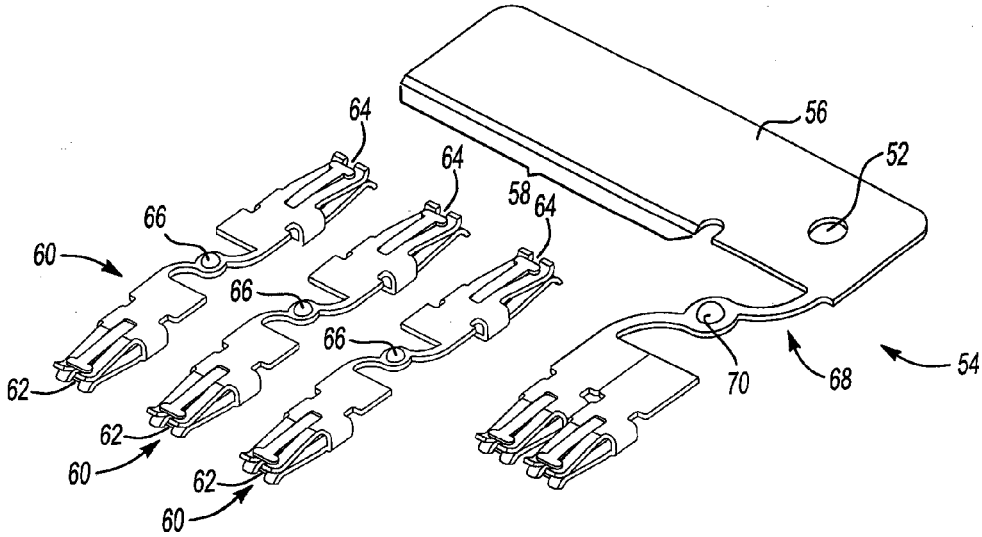
FIG. 9 is a perspective view illustrating an alternate embodiment of a fuse circuit assembly made in accordance with the teachings of the present invention.

With respect to FIG. 9, an alternative embodiment fuse circuit assembly 54 is illustrated. Fuse circuit assembly 54 includes a power distribution bar 56. In the illustrated embodiment, power distribution bar 56 is a plate. One of ordinary skill in the art should understand that power distribution bar 56 may take other forms and have other shapes. Power distribution bar 56 may be made of any electrically conductive material including metals such as copper, copper alloys (C151, C110) and other materials with appropriate conductivity. Power distribution bar 56 includes a interface portion 58 for interfacing with female receiver portions of electrical terminals. In the illustrated embodiment, interface portion 58 is configured similar to the blade portion of a male electrical terminal to permit insertion into female receivers of female electrical terminals. In other embodiments, interface portion 58 may include a plurality of male terminal components such as blades or other fixtures which are configured for insertion into female receiver portions of female electrical terminals. In this manner, female electrical terminals may dock with interface portion 58 of power distribution bar 56.

Fuse circuit assembly 54 also includes a plurality of electrical terminals 60. Each electrical terminal 60 has a first end 62 and a second end 64. Each first end 62 and each second end 64 are configured as female receivers. Each electrical terminal 60 also includes a fuse element 66 disposed between first and second ends 62, 64. Configured in this manner, each individual electrical terminal 60 may dock with power distribution bar 56 at interface portion 58. When an individual electrical terminal 60 experiences an over current event sufficient to blow fuse element 66, then that individual electrical terminal 60 may be removed from power distribution bars 56 without the need to discard the entire fuse circuit assembly 54. In the embodiment illustrated in FIG. 9, fuse circuit assembly 54 includes an additional electrical terminal 68 formed integrally with power distribution bar 56. In the illustrated embodiment, electrical terminal 68 includes a fuse element 70 that is configured to tolerate a higher current before blowing.

Figure 10:
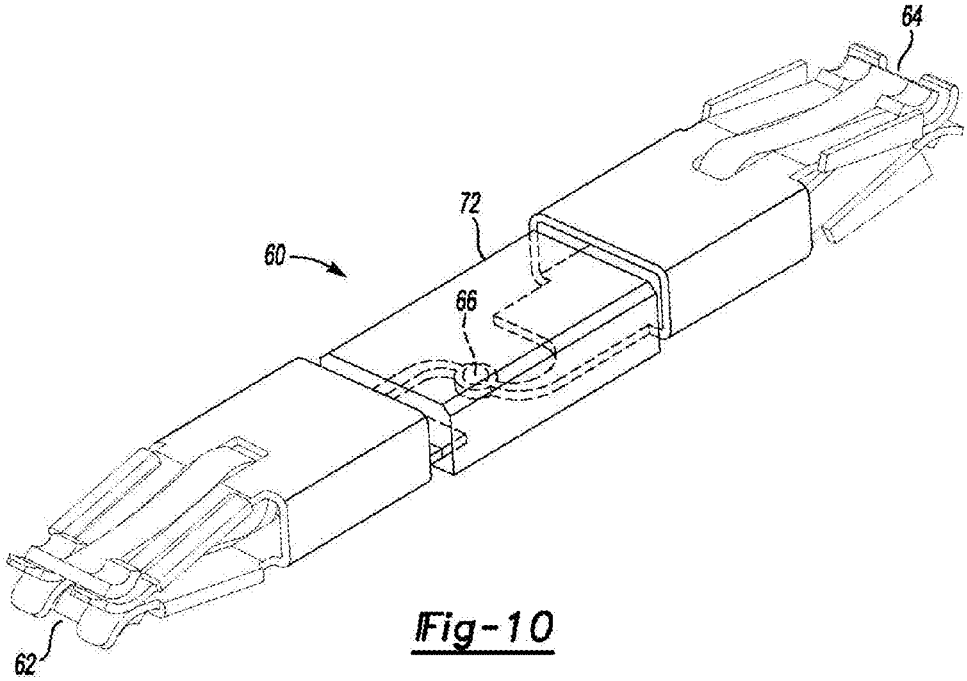
FIG. 10 is a perspective view illustrating an electrical terminal for use with the fuse circuit assembly of FIG. 9.

With respect to FIG. 10, an individual electrical terminal 60 is illustrated. In this embodiment, individual electrical terminal 60 includes an individual housing 72. Individual housing 72 may be made of materials including, but not limited to, high temperature engineering polymers including, but not limited to, amodel, high temperature nylons, and PPS, to provide both a structural support for electrical terminal 60 and also an electrically insulated portion that a user may manipulate.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A fuse circuit assembly comprising:

a power distribution bar for distributing power from a power input, the power distribution bar having an interface for receiving a female terminal; and an electrical terminal having a first end and a second end disposed opposite the first end, the first end and the second end being configured as a female terminal portions that face in opposite directions, the electrical terminal further having a fuse element disposed between the first and the second ends, the fuse element being configured to open at an over current threshold in order to prevent current flow therethrough;

wherein one of the first end and the second end is removably attached to the power distribution bar proximate the interface.

2. The assembly of claim 1 wherein the first end, the second end, and the fuse element are integral with one another.

3. The assembly of claim 1 further comprising a plurality of the electrical terminals, wherein the interface is adapted to receive a plurality of female terminals, and wherein one of the first and the second ends of each respective electrical terminal is removably attached to the power distribution bar proximate the interface.

4. The assembly of claim 3 wherein the respective first end, second end, and fuse element of each electrical terminal are integral with one another.

5. The assembly of claim 1 further comprising a plurality of terminal spring members, one of the terminal spring members being connected to the first end and one of the terminal spring members being connected to the second end of each electrical terminal, the terminal spring member being configured to exert a normal force on the respective first end and second end.

6. The assembly of claim 5 wherein each terminal spring member comprises steel.

7. The assembly of claim 5 wherein each electrical terminal comprises copper.

8. The assembly of claim 1 further comprising a housing for the fuse element.

9. The assembly of claim 8 wherein the housing comprises plastic.

10. The assembly of claim 9 wherein the housing is transparent.

11. A fuse circuit assembly comprising:

a power distribution bar for distributing power from a power input, the power distribution bar having an interface for receiving a female terminal;

a first electrical terminal having a first end and a second end disposed opposite the first end, the first end and the second end being configured as a female terminal portions having spring members that are oriented in opposite directions, the first electrical terminal further having a fuse element disposed between the first and the second ends, the fuse element being configured to open at an over current threshold in order to prevent current flow therethrough; and a second electrical terminal integral with the power distribution bar, the second electrical terminal having a fuse element configured to open at an over current threshold in order to prevent current flow therethrough, and a female terminal portion;

wherein one of the first end and the second end is removably attached to the power distribution bar proximate the interface and wherein the second electrical terminal is capable of tolerating a higher electrical current before opening its fuse element than the first electrical terminal.

* * * * *